US005697655A

United States Patent [19]

Strong

[11] Patent Number: 5,697,655

[45] Date of Patent: Dec. 16, 1997

[54] VIBRATION OPERATED SAFETY LATCHING DEVICE

[76] Inventor: Bernard Strong, 4964 Calvin Ave., Tarzana, Calif. 91356

[21] Appl. No.: 570,624

[22] Filed: Dec. 11, 1995

Related U.S. Application Data

[60] Provisional application No. 60/002/290 Aug. 14, 1995.

[51] Int. Cl.[6] ..... E05C 3/12

[52] U.S. Cl. ..... 292/230; 292/DIG. 22

[58] Field of Search ..... 70/465; 292/DIG. 22, 292/DIG. 65, 230, 231, 134; 273/449, 450, 287, 241, 440, 459, 461; 446/168, 173

[56] References Cited

U.S. PATENT DOCUMENTS

| | | | |
|---|---|---|---|
| 1,743,314 | 1/1930 | Brandon | 200/85 R |
| 2,229,543 | 1/1941 | Bailey | 137/39 |
| 2,615,461 | 10/1952 | Crow | 137/39 |
| 3,300,891 | 1/1967 | Glass et al. | 446/168 |
| 3,568,715 | 3/1971 | Taylor, Jr. | 137/613 |
| 3,637,245 | 1/1972 | Levack | 292/45 |
| 3,744,830 | 7/1973 | Levack | 292/29 |
| 3,878,858 | 4/1975 | Yamada | 137/38 |
| 4,007,643 | 2/1977 | Matsushita | 74/2 |
| 4,103,697 | 8/1978 | Kiesow | 137/45 |
| 4,185,507 | 1/1980 | Domyan | 74/2 |
| 4,371,143 | 2/1983 | Ishida et al. | 248/638 |
| 4,511,114 | 4/1985 | Cawley | 248/550 |
| 4,513,629 | 4/1985 | Keller et al. | 74/2 |
| 4,542,760 | 9/1985 | Flauiani | 137/45 |
| 4,632,438 | 12/1986 | McKinney | 291/87 |
| 4,763,869 | 8/1988 | Nakamura et al. | 248/562 |
| 4,789,922 | 12/1988 | Cheshire | 362/158 |
| 4,815,574 | 3/1989 | Taylor et al. | 188/280 |
| 4,844,113 | 7/1989 | Jones | 137/39 |
| 4,915,122 | 4/1990 | Ikegaya et al. | 137/38 |
| 4,941,640 | 7/1990 | Nakamura et al. | 248/562 |
| 5,035,451 | 7/1991 | Brady | 292/96 |
| 5,050,629 | 9/1991 | Willoughby | 137/38 |
| 5,114,193 | 5/1992 | Nass | 292/67 |
| 5,119,841 | 6/1992 | McGill | 137/38 |
| 5,147,099 | 9/1992 | McLinden et al. | 292/175 |
| 5,152,562 | 10/1992 | Stevenson et al. | 292/252 |
| 5,209,454 | 5/1993 | Engdahl et al. | 251/65 |
| 5,307,699 | 5/1994 | Engdahl et al. | 74/2 |
| 5,312,143 | 5/1994 | Buckner | 292/230 |
| 5,360,243 | 11/1994 | Hirsh | 292/144 |

*Primary Examiner*—Rodney M. Lindsey
*Attorney, Agent, or Firm*—Lyon & Lyon LLP

[57] ABSTRACT

A ball operated, automatic vibration safety latching device including a cantilevered arm which is gravity biased to a radial position to leave a catch normally disengaged, a ball positioned atop a ball support, and a retaining cup attached to the arm and arranged beneath the ball support. Any undue vibration such as that caused by an earthquake or nearby explosion will dislodge the ball causing the ball to drop into the retaining cup which will cause the cantilevered arm to rotate around its pivot so as to then engage the catch or otherwise block the door. A single latching device may be used with two catches to serve two doors or other items that need to be restrained. The door is normally completely unimpeded and only requires unlatching in the event that undue vibration has occurred since the door was last closed. Unlatching the arm allows the door to be opened and automatically resets the device to the normal unlatched mode.

14 Claims, 10 Drawing Sheets

50
5
4
1
12
8
11
9
3
10
15
2
6
7
16
19
17

18
16
2
13
1
11
1a
16a

VIBRATION OPERATED SAFETY LATCHING DEVICE

PRIORITY APPLICATION

This application is a continuing application of provisional application Ser. No. 60/002,290 filed Aug. 14, 1995.

BACKGROUND

The present invention relates to a vibration operated safety closure devices. The present inventor has recognized that it would be desirable for a safety latch device to provide for (a) unhindered operation with its catching mechanism inoperative under normal operating conditions and (b) automatic activation of the catch in the event of any undue vibration. Many of the prior art devices are complex and expensive to manufacture. Vibration sensing devices such as the following U.S. Pat. Nos. Brady 5,035,451, Matsuchita 4,007,643, Yamada 3,878,858, Buckner 5,312,143, Engdahl 5,307,699, Domyan 4,185,507, Keller 4,513,629 are relatively complicated and/or costly to manufacture and all require expensive springs and/or magnets, mandate precise adjustments and are not equally sensitive in all directions. There is a need for a simple self-calibrating, low-cost automatic latch without either springs or magnets, particularly one that is equally sensitive in every direction.

SUMMARY OF THE INVENTION

The present invention relates to a device which reacts to vibration to actuate an apparatus, particularly to maintain closure of a door, drawer or the like. In its preferred application, the device comprises a safety latching mechanism in which the latching mechanism is actuated upon being subjected to a sufficient vibration. The safety latch mechanism includes a cantilevered arm and a spherical ball which sits upon an open-ended ball support, the support having a center hole or indentation with an inner diameter selected according to the diameter and weight of the spherical ball. Upon encountering vibration, the ball is unseated from its resting position on the ball support and falls into the retaining cup located on one end of the cantilevered arm. The cantilevered arm pivots moving an arm portion into a desired position. In its preferred application, the arm portion includes a catch which when pivoted into the "closing" position mates with a corresponding catch attached to the door preventing its opening.

DETAILED DESCRIPTION OF THE PREFERRED EMBODIMENT

Figure 1:
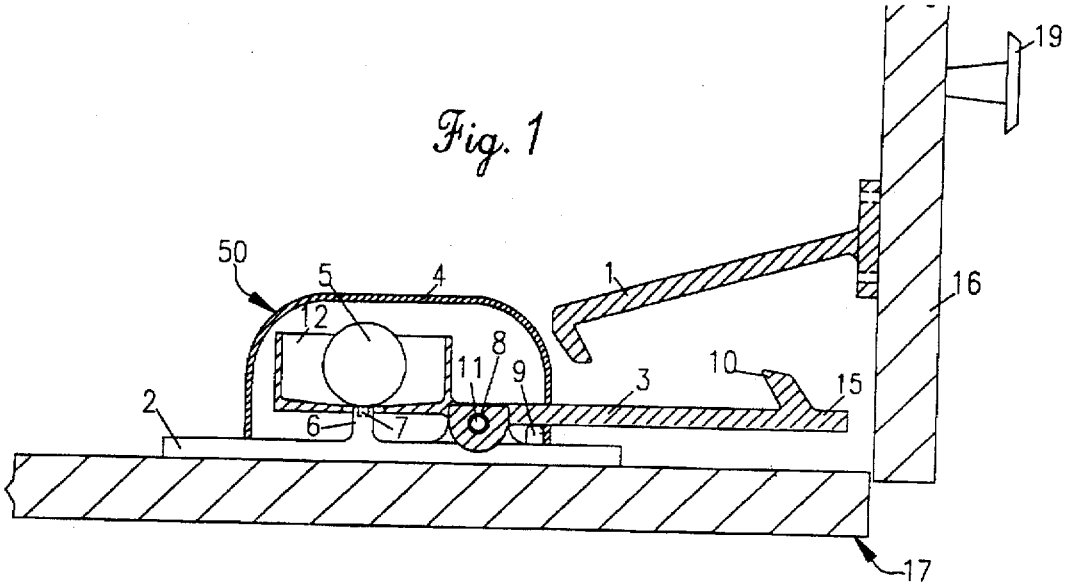
FIG. 1 is a front view in partial cross section of a preferred latch mechanism according to the present invention, the mechanism being in its normal unlatched mode, installed within a typical two door cabinet.

FIGS. 1–6 illustrate a preferred embodiment for a latch system according to the present invention. The latch mechanism 50 includes a base 2 which is securable to the bottom surface of the cabinet 17, a housing 4, a cantilevered arm 3 pivoting about pivot pin 11, a spherical ball 5 resting atop a ball support 6, and a retaining cup or basket 12 having a centered hole **12*a* in a bottom portion thereof. Upon experiencing vibration of sufficient amplitude, the latch mechanism 50 actuates to pivot its cantilevered arm 3 into position to grasp the catch hook 1. The catch hook 1 is mounted to the door 16 of the cabinet 17 at a sufficient height to allow the door 16, which pivots about its hinge 18, to be opened and closed without engaging the end latch 10 of cantilevered arm 3 when spherical ball 5 is atop ball support 6. The ball support 6 operates as a "tee" or "perch" which includes a locating hole or indention 7 which positions the ball 5 atop the support 6**.

Figure 4:
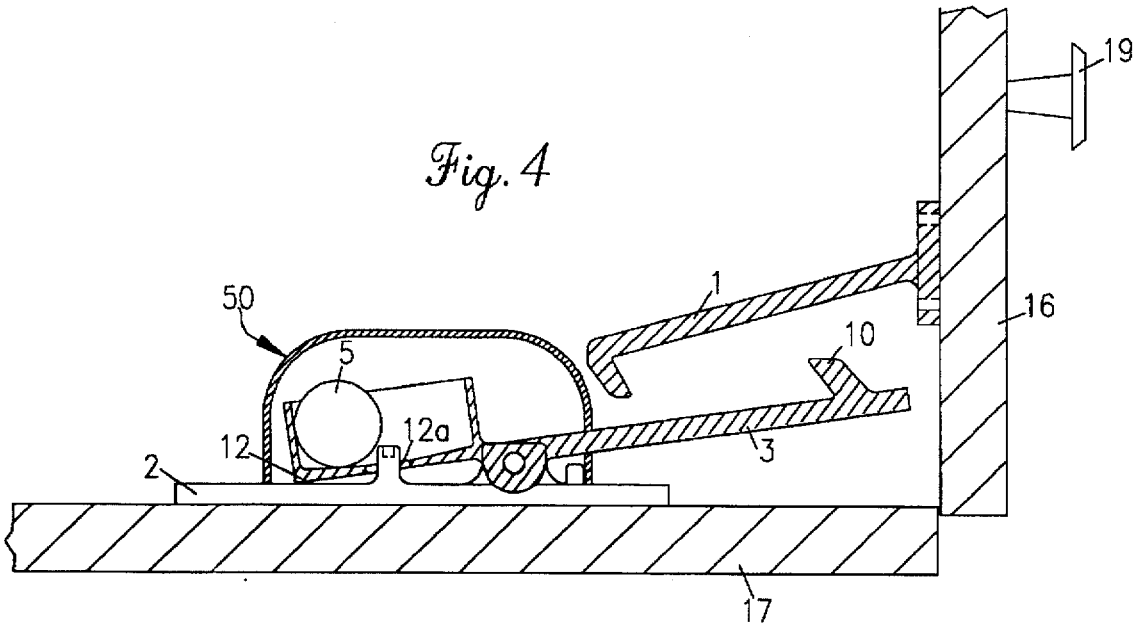
FIG. 4 is a front view of the mechanism of FIG. 1 showing the mechanism in its operated or latched mode wherein the spherical ball has dislodged causing the latch to rise to its locked position.

The arm 3 is free to rotate radially approximately eight degrees about the pivot pin 11 within the pivot hole 8, such rotation being limited in the unlatched position by a stop 9 in the base 2 and limited in the latched position by retaining cup 12 hitting base 2 (see FIG. 4). Referring again to FIG. 2, the pivot support 13, which is an integral part of the base 2, is fitted with a pivot pin 11 which passes though both arms of the pivot support 13 and the pivot hole 8 in the cantilevered arm 3. By virtue of its geometric design and placement of the pivot hole 8, the arm 3 is gravity biased (in a clockwise direction as viewed in FIG. 1) so as to normally rest in the unlocked position as shown in FIG. 1 when the ball 5 is in position atop the ball support 6.

Figure 3:
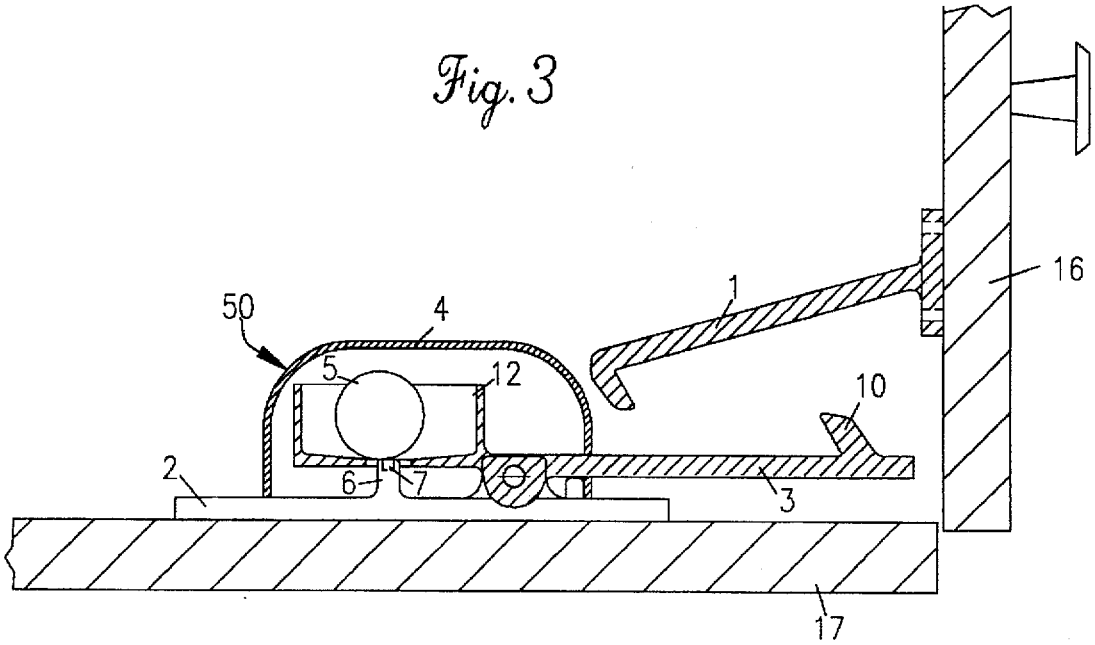
FIG. 3 is a front view of the mechanism of FIG. 1 in which the spherical ball has just commenced moving.
Figure 5:
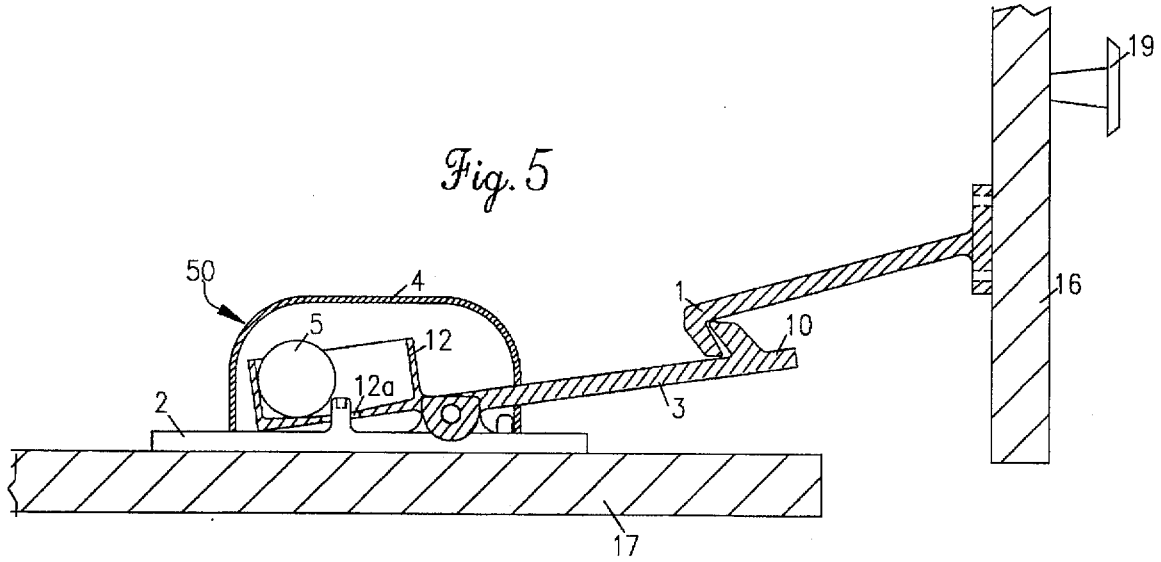
FIG. 5 is a front view of the mechanism of FIG. 4 illustrating how the cabinet door is restrained by the catch hook to prevent the door from opening when the latch is actuated.

Referring to FIG. 3, when the mechanism 50 is subjected to vibration of a predetermined magnitude, the spherical ball 5 is dislodged from its normal resting position within the locating hole 7 atop the ball support 6. Such vibration may occur in any direction or combination of directions and the ensuing dislodgement will cause the ball 5 to fall off the ball support 6 and come to rest upon the bottom of the retaining cup 12. The weight of the spherical ball 5 is sufficient to completely overcome the normal gravity bias of the cantilevered arm 3 thereby causing the arm 3 to rotate (counterclockwise as viewed in the figure) up to the limit of its travel (as viewed in FIG. 4) wherein the lower edge of the retaining cup 5 contacts the base 2 stopping the rotation. The angle thus assumed by the cantilevered arm 3 then aligns the end latch 10 of the arm 3 with the catch hook 1 to preclude opening of the door 16. Any attempt to open door with knob 19 or by any other means (such as vibration or the weight of items pressing against it) will result in the complete engagement of catch hook 1 with end latch 10 thus effectively restraining the door as depicted in FIG. 5.

Figure 6:
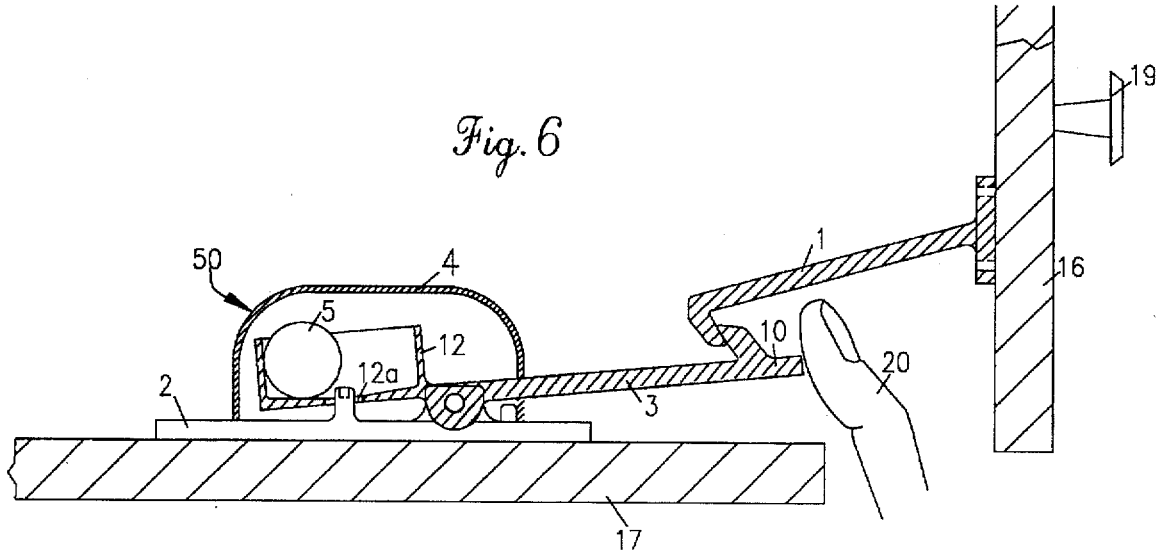
FIG. 6 is a front view of the mechanism of FIGS. 1–5 illustrating how the user unlatches the door by depressing the restoring tab which both disengages the catch hook allowing the door to be opened and at the same time restores the spherical ball to its normal position atop the ball support.

Referring to FIG. 6, to open the door 16 the user merely inserts a finger 20 just under the lower edge of the partially opened door and depresses end latch 10 to disengage the latch 10 from interlocking with catch hook 1. The end latch 10 may be depressed to rotate the arm 3 (clockwise as viewed in FIG. 6) approximately eight degrees to restore it to its normal unlatched position as depicted in FIG. 1. The bottom portion of the retaining cup 12 is downwardly sloped toward the centered hole 12*a* so that as the retaining cup 12 is moved upward above the top of the ball support 6, the ball 5 is urged downward to the hole 12*a* directly above the ball support 6 thereby depositing the ball 5 onto the ball support 6 resetting the mechanism. Alternately, the user may deflect the catch hook 1 away from the latch end 10 (the arm of the catch hook 1 being sufficiently flexible) in similar fashion to method of opening a child safety latch.

In a preferred configuration, the arm 3 flexes slightly in the resetting operation, raising the retainer cup 12 and ball 5 slightly above the ball support 6, and upon release, the retainer cup will unflex to a position slightly below the ball 5 as it rests atop the ball support 6.

Figure 7A:
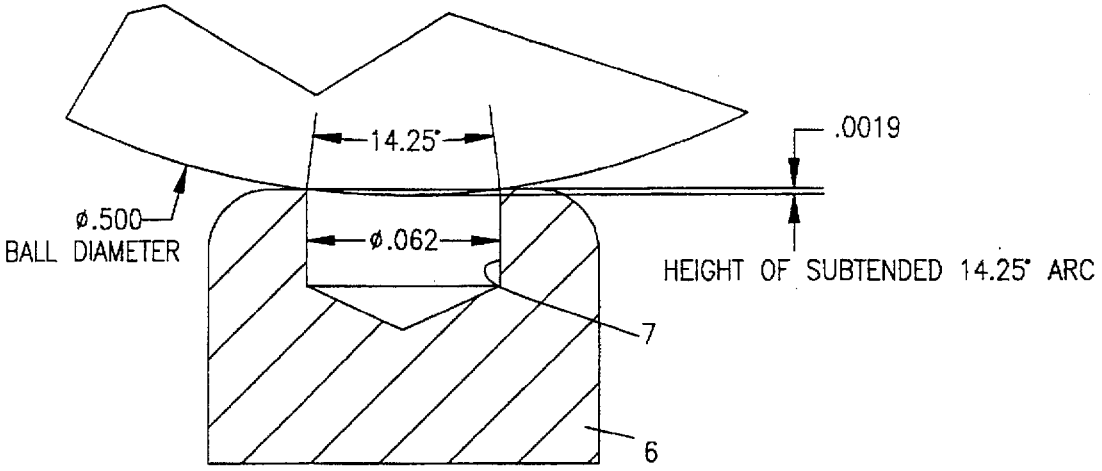
FIGS. 7A and 7B depict magnified views of two typical ball supports showing the relationship of the spherical ball to its seating depth within locating holes of different diameters.
Figure 7B:
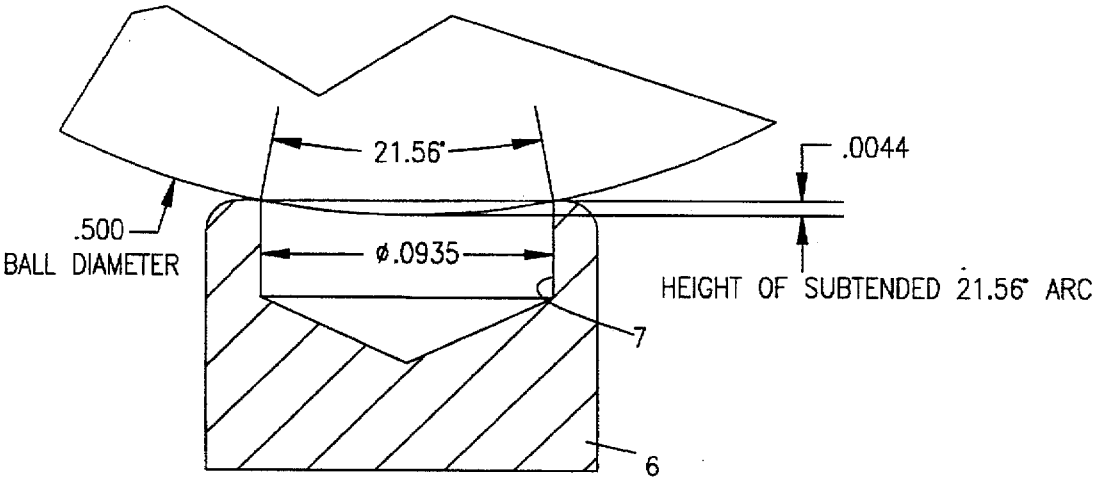

The latch mechanism 50 may be readily produced within a very wide range of sensitivities by the choice of spherical ball size and weight and selected variation in the sizing of the locating hole 7 for the balls. The mechanism 50 may be constructed such that no adjustments need be required or provided in the finished assemblies. Referring to FIGS. 7A and 7B, these magnified views show some typical practical sizes for spherical balls and matching locating holes that have been found to provide excellent results as summarized in the following Table A:

TABLE A

| ball diameter b | locating hole diameter d | subtended arc a | height of subtended arc h |
|---|---|---|---|
| 0.500 in | 0.062 in | 14.25° | 0.0019 in |
| 0.500 in | 0.0935in | 21.56° | 0.0044 in |

Figure 2:
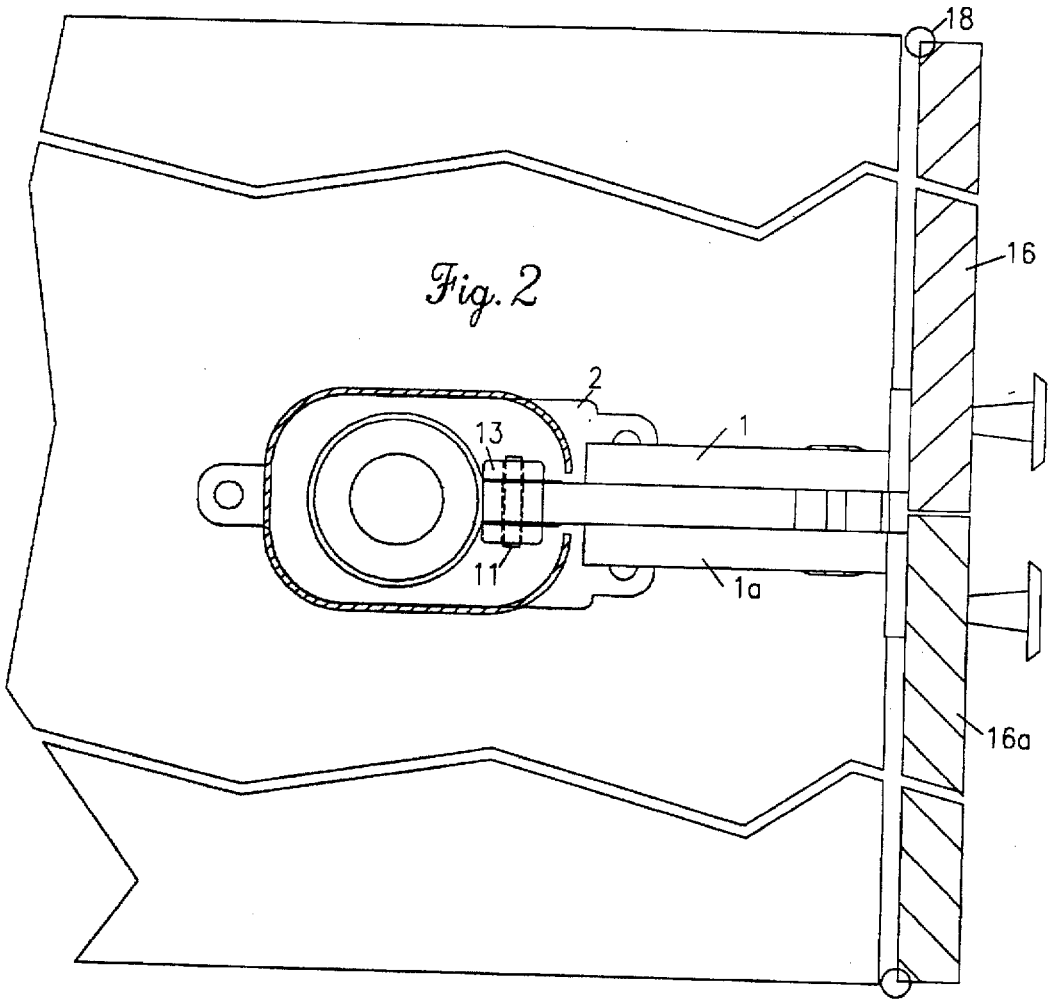
FIG. 2 is a top view of the mechanism of FIG. 1 in partial cross section.

The choice of the locating hole diameter d determines the seating depth h of the ball within the hole of the ball support and such depth influences the sensitivity of the device. The seating depth h is a function of the subtended arc a of the chord of the selected ball diameter b of the spherical ball employed. The cantilevered arm 3 incorporates a pivot hole 8, a retaining cup 12 for the ball 5, an end latch 10 and a restoring tab 15. A protective cover 4, which is preferably non-removable, may be provided to ensure that any items stored adjacent to the safety latch cannot interfere with its operation. The catch hook 1 is adjacently mounted on the door 16. Advantageously, double doors 16, 16*a* can be protected by a single mechanism (as shown in FIG. 2) by mounting catch hooks 1, 1*a* on each of the doors 16, 16*a*.

Figure 8:
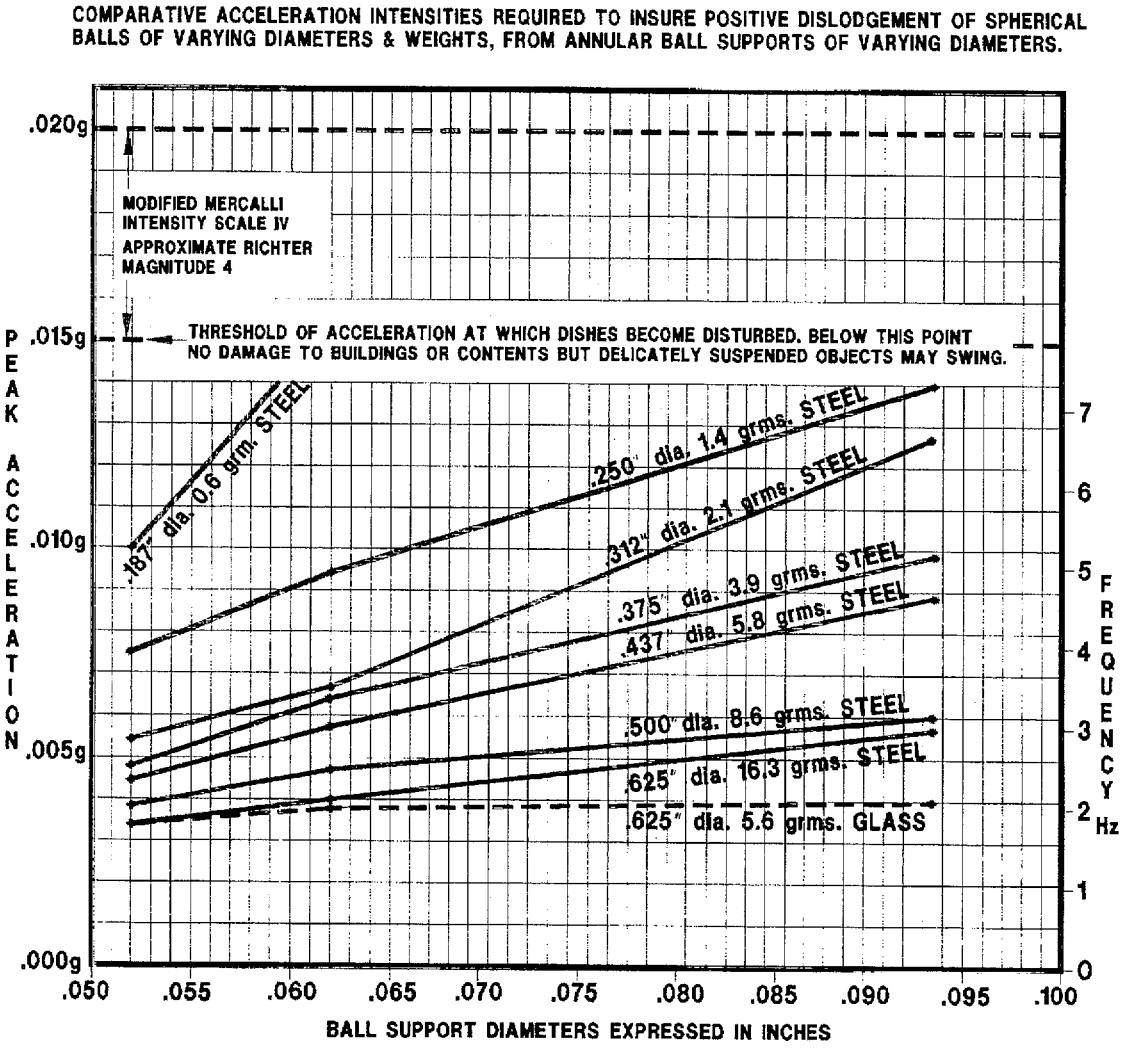
FIG. 8 is a graph illustrating preferred comparative acceleration intensities to ensure positive displacement of balls of varying diameters and weights, from annular ball supports of varying sizes.

The mass of the ball 5 also influences both the sensitivity of the mechanism to vibration and the force of the pivoting action upon activation. The ball 5 may be made of steel, glass or other suitable material. FIG. 8 depicts a graph of the comparative acceleration intensities required to insure positive dislodgement of spherical balls of varying diameters and weights from annular ball supports of varying diameters. Using this information, one skilled in the art may construct a latch suited to the desired application. As expected by the inventor and shown by this graph, there is almost a straight line relationship between the acceleration required for dislodgement of a ball of any one size and weight when used with varying sizes of annular ball supports. The larger the annular diameter of the ball support the higher the threshold of dislodgement. The higher the ball weight, the higher the threshold of dislodgement. Dishes first commence to be disturbed at 0.015 g which is the lower end of band IV of the Modified Mercalli Intensity Scale that approximates a 4 Richter Magnitude earthquake. To insure an adequate safety margin of about 3:1, the mechanism should operate positively at an acceleration threshold not exceeding 0.005 g (i.e., at 0.005 g the ball should be dislodged from its seat). As may be read directly from the graph, this acceleration is well within the limitations imposed when employing a 0.062" ball support with either a 0.625" or 0.500" steel ball or alternatively a 0.625" diameter glass ball, these sizes being suitable dimensions for latch mechanisms of a size corresponding to a kitchen cabinet, for example. A complete latch mechanism may therefore be mass produced in a single size and configuration, and the sensitivity readily adjusted to any desired amount (for a given desired application) by simply changing the ball weight and/or size.

The mechanism may be surrounded by a housing 4 mounted to the base 2. The housing includes an opening in one side thereof through which the arm passes. The opening is of sufficient height to allow for the pivoting action of the arm 3. The mechanism 50 may be mounted by attaching the base 2 to a secure surface (such as the bottom surface of the cabinet 17 as shown in FIG. 1) or may be side mounted, securing the side of the housing 4 to a vertical surface. The mechanism 50 may also be installed using a suitable mounting bracket.

Though the mechanism is preferably mounted in a relatively level horizontal position, the mechanism may be mounted to any suitable surface be it vertical or horizontal by using top or side mounts as required. FIGS. 1–2 for example illustrates the mechanism mounted to the bottom horizontal surface of the cabinet 17. Alternately, the mechanism may be mounted to the underside surface of the bottom of the cabinet 17 with a suitable mount on the top surface of housing 4 (in such a configuration, the mechanism may be mounted closer to the door 16 possibly not requiring a separate catch thereon). Depending upon its configuration, the latching mechanism need not require the separate catch hook 1 mounted to the door as shown in FIGS. 1–6. Alternately, the device may be configured such that the end latch 10 merely pivots into position to block the opening of the door.

Figure 9:
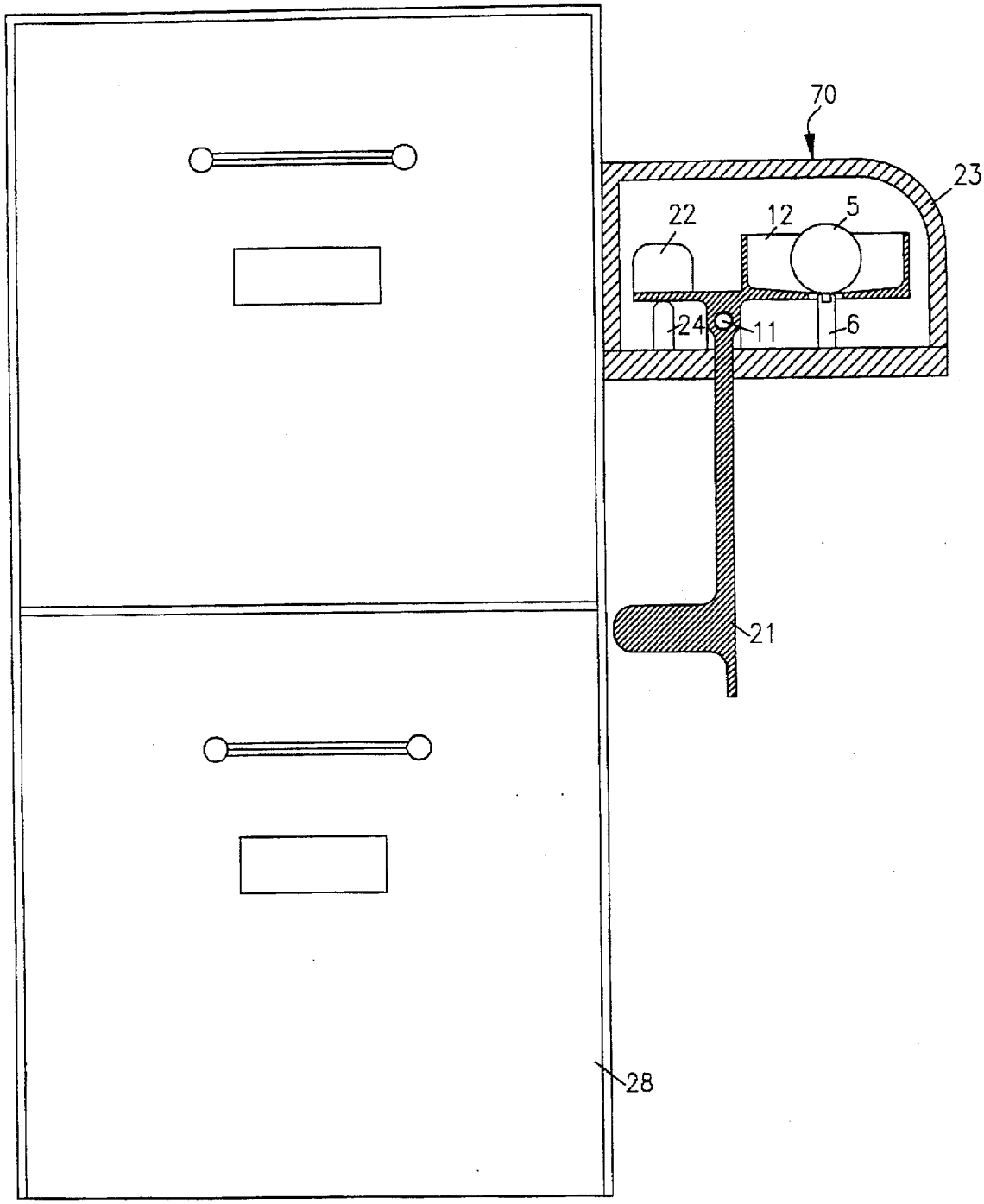
FIGS. 9 & 10 illustrate an alternative embodiment including a blocking arm for use in a side mounting configuration, the mechanism being drawn on an enlarged scale relative to the cabinet.
Figure 10:
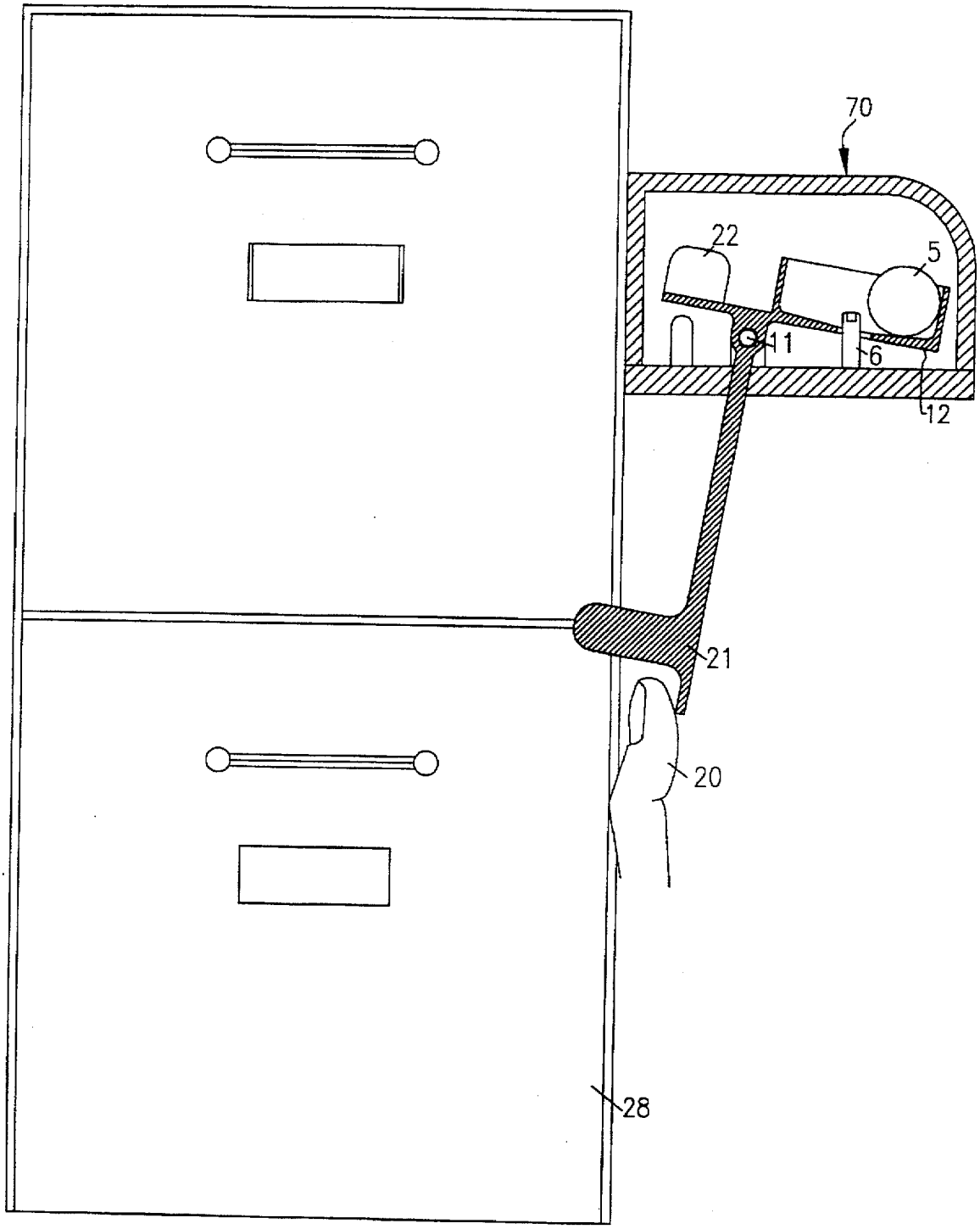

FIG. 9 depicts an alternative embodiment when used to block a door, in this instance a latch device 70 device is illustrated to block or lock a double filing drawer 28. The device 70 includes a pivot mounted blocking arm 31 having an integral upper portion which includes the retaining cup 12 radially disposed on one side of pivot pin 11 (i.e. to the right as viewed in the figure). A counterweight 22 is mounted upon the upper portion of the arm 24 but radially disposed to the opposite side of the pivot pin 11 (i.e. to the left as viewed in the figure). The counterweight 22 has a mass which suffices to ensure that blocking arm 24 is normally gravity biased (counter-clockwise as viewed in the figure) so that the lower side of the upper portion of the blocking arm 21 is in positive contact with the top of limit pin 24. The spherical ball 5 normally rests atop the ball support 6 and the assembled device is enclosed within side cover or housing 23. When the mechanism 70 is subjected to vibration in excess of its specified acceleration threshold, the spherical ball 5 will be dislodged from ball support 6 and fall into the retaining cup 12 with the weight of the ball being sufficient to overcome counterweight 22 thus causing blocking arm 21 to rotate (clockwise as viewed in the figure) to the position shown in FIG. 10 in which position it blocks the opening of both drawers.

Restoration of the mechanism 70 to the normal unblocked mode is effected by first closing both drawers and then pressing blocking arm 21 to the right as shown with finger 20 so causing the arm to unblock as it is rotated counter-clockwise about pivot 11 and concurrently replaces the spherical ball 5 atop the ball support 6 at which time the drawers are free to open and the mechanism is restored to its vibration-detecting mode.

Figure 11:
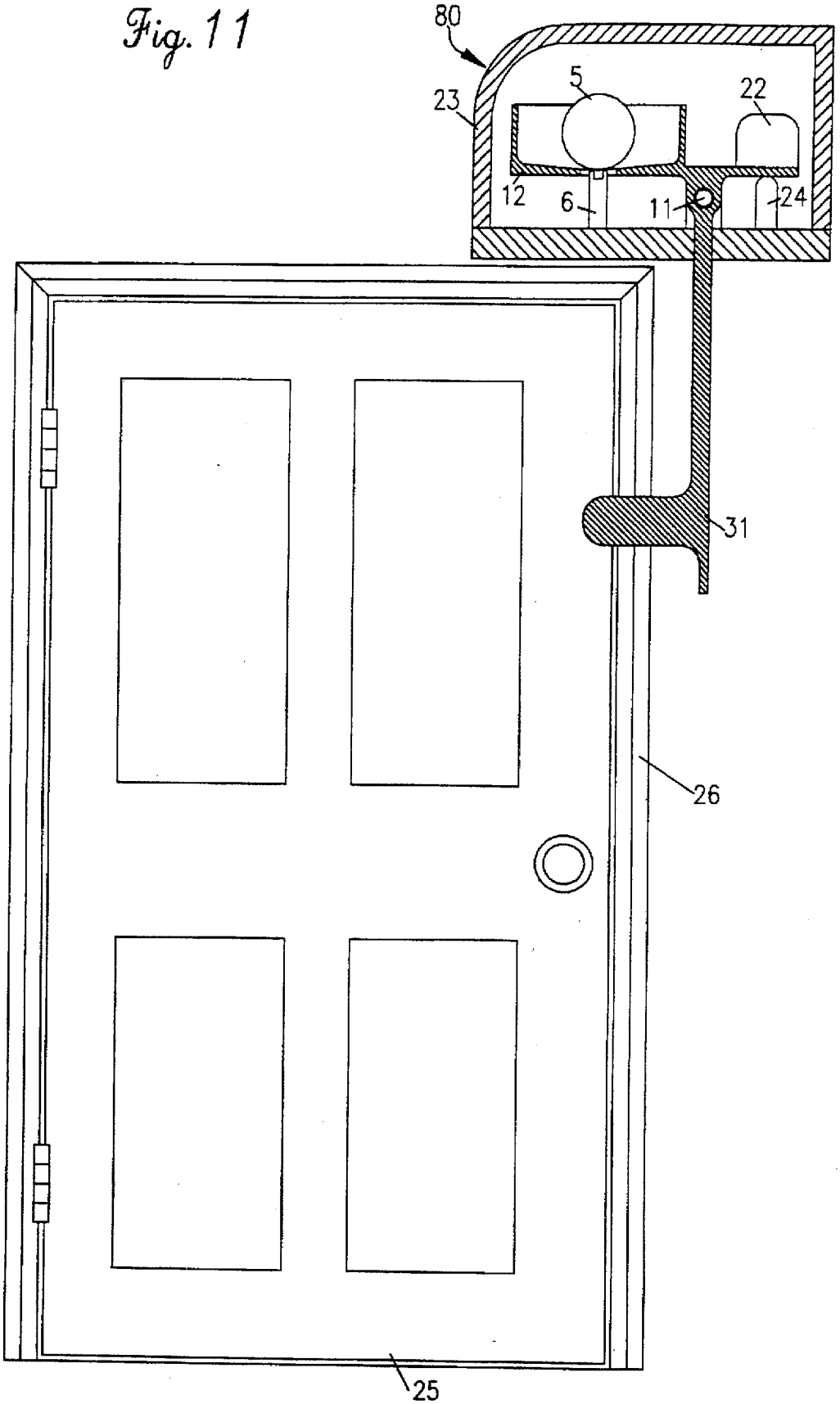
FIGS. 11 & 12 illustrate another alternate embodiment with a reversed blocking arm for use on doors that need to be normally locked but which have to be automatically unlocked in the event of undue vibration, the mechanism being drawn on an enlarged scale relative to the doors.
Figure 12:
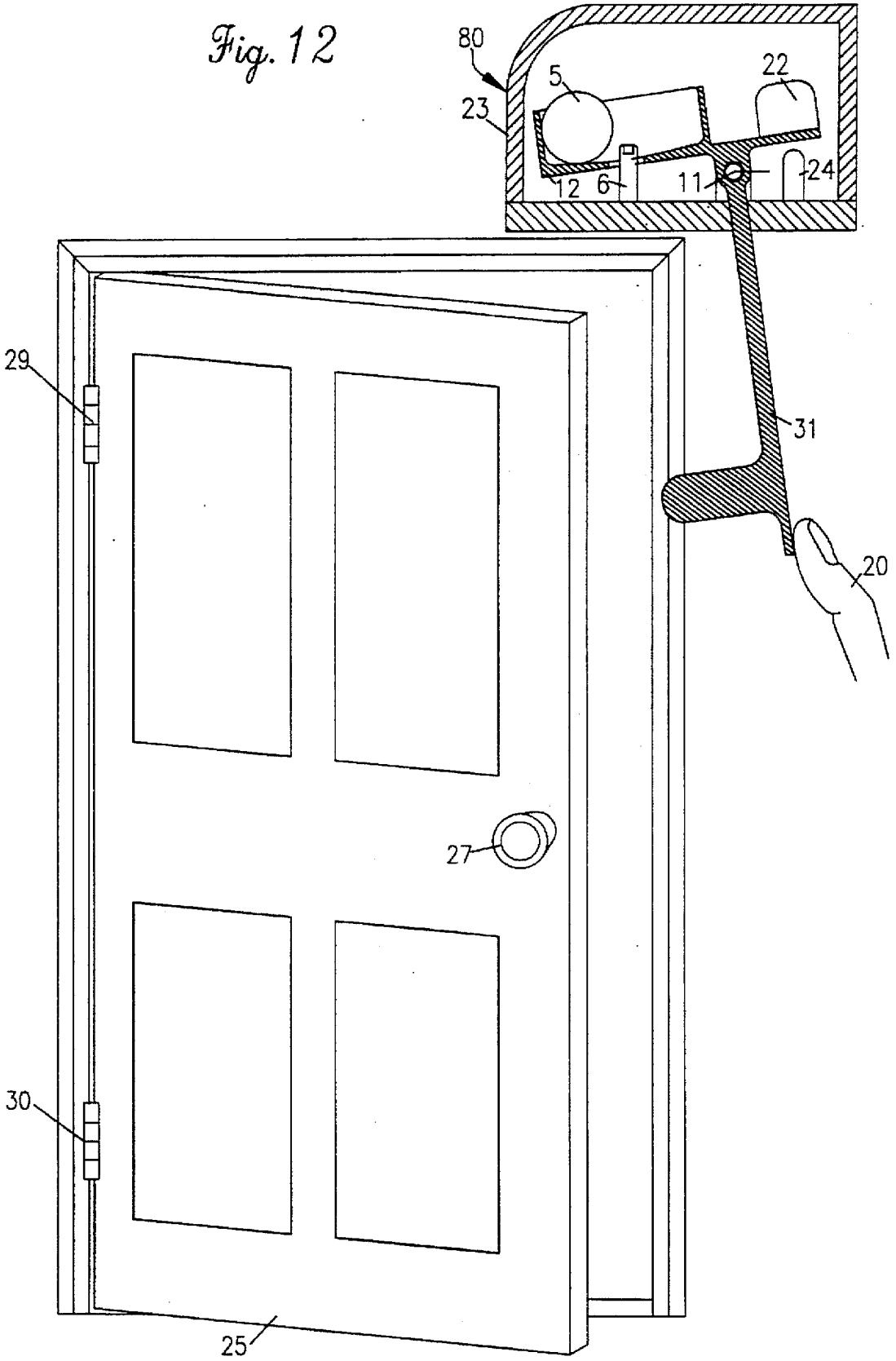

FIG. 11 shows yet another embodiment of a latch mechanism 80 which allows for a reversed type of operation where the normal mode is locked or blocked, becoming unlocked or unblocked when operated. The door 25 is secured to door frame 26 by an upper hinge 29 and a lower hinge 30. The mechanism 80 includes a blocking arm 31 having an integral upper portion which includes retaining cup 12 radially disposed to one side of the pivot pin 11 (i.e. to the left as viewed in the figure). A counterweight 22 is mounted upon the upper portion but radially disposed to the opposite side of the pivot pin 11 (i.e. to the right as viewed in the figure). The counterweight has a mass which suffices to insure that door blocking arm 31 is normally gravity biased (clockwise as viewed in the figure) so that the lower side of the upper portion of the door blocking arm 31 is in positive contact with the top of limit pin 24 and the lower end of the arm 31 blocks the door 25 preventing it from opening. The spherical ball 5 normally rests atop ball support 6 and the internal mechanism is enclosed within the side cover or housing 23. Vibration in excess of the specified acceleration threshold limit will dislodge the spherical ball 5 from the ball support 6 and the weight of the ball falling into the retaining cup 12 will suffice to overcome counter-weight 22 thus causing door blocking arm 21 to rotate (counter-clockwise) to the position shown FIG. 12 leaving door 25 free to be opened by pulling on knob 27 causing the door to open as it pivots about hinges 29, 30. Restoration to the normal blocked mode is effected by first closing the door 25 and then pressing door blocking arm 31 to the left as shown with a finger 20 to rotate the door blocking arm 31 clockwise about pivot pin 11 thereby lifting the spherical ball 5 and replacing it atop the ball support 6. Counterweight 22 maintains the equilibrium of the system by causing the lower face of the upper portion of door blocking arm 31 to stay in positive contact with the top of limit pin 24.

The door unlocking mechanism 80 may also be used in any type of transportation vehicle to provide for the automatic unlocking of emergency exits and doors in the event of a collision or other undue impact.

In the normal unactuated mode and as it relates to all the aforementioned embodiments, the weight of the spherical ball 5 rests solely upon ball support 6 making no other contact while in this mode.

For the purposes of the present disclosure, a latch mechanism according to the invention may operate in latching mode and/or blocking mode depending upon its particular configuration or application. For example, the mechanism 50 illustrated in FIGS. 1–6 operates in a latching mode whereby the arm 3 operates in tension. Alternately, the latch mechanism may be mounted on the opposite side of the door and thereby operate in a blocking mode (i.e. in compression). In such a configuration, upon actuation the arm 3 would pivot upward into a blocking position preventing the door from opening. FIGS. 9–12 illustrate two other embodiments of a blocking mode whereby the arm (21 or 31) blocks the opening of the doors, the arm being placed in torsion when the door is attempted to be opened.

Figure 13:
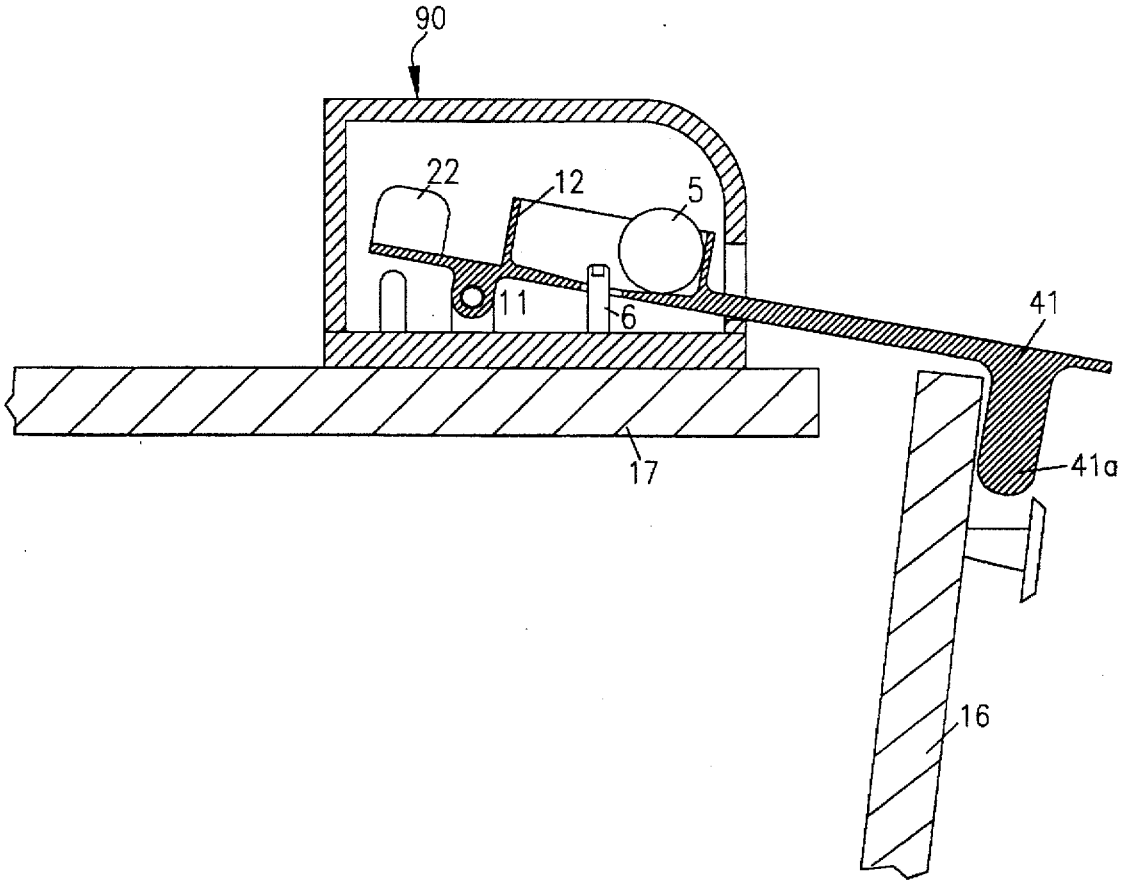
FIG. 13 illustrates another alternate embodiment for a latch mechanism.

FIG. 13 illustrates yet another alternate latching mechanism 90 such that the latching (or blocking) arm portion 41 comprises an extension past the basket 12 (i.e. to the right as viewed in FIG. 13). In its operation-ready state with the ball 5 atop the ball support 6, the counterweight 22 on one side of the pivot 11 (to the left as viewed in the figure) exerts sufficient torque to counter-balance the torque exerted by the basket 12 and the arm 41. In the operation-ready state, the arm 41 is horizontal, clear of the door 16 permitting the door 16 to be opened. Upon experiencing vibration of sufficient magnitude to dislodge the ball 5, the ball 5 falls into the basket 12, the arm portion 41 is pivoted downward along with the basket 12, inhibiting opening of the door 16. The arm 41 operates in tension (when the door is attempted to be opened), but does not use a separate catch hook such as in the embodiment of FIG. 1. Being external to the cabinet, the mechanism 90 may be aesthetically less desirable due to its more visible location. This alternate configuration may nonetheless be preferred depending upon the particular application because the mechanism 90 may be easier to operate (being external to the cabinet it is more readily accessible) and less expensive to manufacture and install (not requiring the separate catch hook).

In its various embodiments, the mechanism provides a vibration operated safety latching device of simple construction which may be made economically such as from very inexpensive and/or recycled materials. The components may be readily fabricated from molded plastic with the ball being of glass or steel, but other materials would be suitable depending upon the particular application. The mechanism will reliably and automatically operate when a pre-specified threshold of vibration is exceeded.

Thus, a vibration actuated safety closure (or opening) device has been shown and described. Though certain examples and advantages have been disclosed, further advantages and modifications may become obvious to one skilled in the art from the disclosures herein.

What is claimed is:

1. A vibration actuated latch mechanism for a door comprising:

a base;

a pivot mounted on the base;

an arm pivotally mounted on the pivot, the arm comprising a latch end and a retaining cup, the retaining cup having a hole in a bottom portion thereof;

a ball support mounted on the base and extending upward through the hole in the retaining cup; and a ball positionable atop the ball support, wherein the arm is balanced so as to be pivotally biased via gravity in a first rotational direction to locate the latch end of the arm in a first position, and wherein the ball and ball support are constructed and arranged that upon being subjected to a predetermined vibration, the ball is dislodgeable from its position atop the ball support and into the retaining cup, whereupon the ball adds to mass of the retaining cup causing the arm to pivot in a rotational direction opposite to the first rotational direction thereby moving the latch end of the arm to a second position.

2. A mechanism according to claim 1 wherein the arm in the first position permits the door to be opened and when pivoted to the second position, the arm inhibits opening of the door.

3. A mechanism according to claim 2 wherein upon movement to the second position, the latch end of the arm is in a position which blocks opening of the door.

4. A mechanism according to claim 2 wherein the arm includes a hook portion at the latch end which upon movement to the second position engages a mating hook portion protruding from the door.

5. A mechanism according to claim 1 further comprising a hook portion at the latch end of the arm; and a catch hook mountable to the door, the catch hook cooperating with the hook portion of the arm to inhibit opening of the door when the arm is pivoted to the second position.

6. A mechanism according to claim 1 wherein the bottom portion of the retaining cup is downwardly sloped in a radially inward direction toward the hole.

7. A mechanism according to claim 1 wherein the ball is positionable onto the ball support by manual rotation of the arm in the first direction.

8. A mechanism according to claim 1 wherein the ball support has a diameter and the ball has a diameter and weight such that the ball is unseated from atop the ball support upon being subjected to an acceleration of 0.005 g.

9. A mechanism according to claim 1 further comprising a housing having an opening on one side thereof through which the arm passes.

10. A mechanism according to claim 1 wherein the mechanism is mountable to selectively secure two doors with a single arm.

11. A vibration actuated mechanism comprising:

a pivotally mounted arm;

a ball support positioned adjacent to the arm;

a ball positionable atop the ball support, the arm being balanced so as to be pivotally biased via gravity in a first rotational direction to locate a first end of the arm in a first position;

the ball and ball support being constructed and arranged that upon being subjected to a predetermined vibration, the ball is dislodgeable from its position atop the ball support and onto one side of the arm causing the arm to pivot in a rotational direction opposite to the first rotational direction thereby moving the first end of the arm to a second position; and means for repositioning the ball onto the ball support by rotation of the arm in the first rotational direction.

12. A vibration actuated latch mechanism comprising:

a base;

a pivot mounted on the base;

an arm having a first end and a second end, the arm being pivotally mounted on the pivot between the first end and the second end;

a retaining cup on the first end of the arm, the retaining cup having a hole in a bottom portion thereof;

a ball support mounted on the base and extending upward through the hole in the retaining cup; and a ball positionable atop the ball support, wherein the arm is pivotally balanced without springs so as to be biased via gravity in a first rotational direction to locate the first end of the arm in a first position, and wherein the ball and ball support are constructed and arranged that upon being subjected to a predetermined vibration, the ball is dislodgeable from its position atop the ball support and into the retainer cup, whereupon the ball adds to mass of the retainer cup causing the arm to pivot in a rotational direction opposite to the first rotational direction thereby moving the second end of the arm to a second position.

13. A mechanism according to claim 12 further comprising a latch hook on the second end of the arm;

a door; and a catch hook mounted to the door, the catch hook cooperating with the latch portion of the arm to inhibit opening of the door when the arm is pivoted to the second position.

14. A mechanism according to claim 12 further comprising a latch hook on the second end of the arm;

a first door and a second door;

a first catch hook mounted to the first door, the first catch hook cooperating with the latch portion of the arm to inhibit opening of the first door when the arm is pivoted to the second position;

a second catch hook mounted to the second door, the first catch hook cooperating with the latch portion of the arm to inhibit opening of the second door when the arm is pivoted to the second position.

* * * * *